United States Patent [19]

French et al.

[11] 4,183,539

[45] Jan. 15, 1980

[54] SEAL HEAT SHIELD

[75] Inventors: James M. French, Plainfield; Samuel R. Thrasher, Indianapolis, both of Ind.

[73] Assignee: General Motors Corporation, Detroit, Mich.

[21] Appl. No.: 959,867

[22] Filed: Nov. 13, 1978

[51] Int. Cl.[2] ..... F28D 19/00; F16J 15/34

[52] U.S. Cl. ..... 277/22; 277/81 R; 165/9

[58] Field of Search ..... 277/81 R, 81 P, 88, 277/96 R, 235 A, 22; 165/9

[56] References Cited

U.S. PATENT DOCUMENTS

| | | | |
|---|---|---|---|
| 3,743,008 | 7/1973 | Zeek et al. | 277/96 X |
| 3,856,077 | 12/1974 | Siegla | 277/88 X |
| 3,913,926 | 10/1975 | Rao | 277/235 A X |
| 3,954,135 | 5/1976 | Hewlitt | 165/9 |
| 4,056,141 | 11/1977 | Sakaki | 165/9 |
| 4,071,076 | 1/1978 | Sakaki | 277/81 R X |

*Primary Examiner*—Robert S. Ward, Jr.

*Attorney, Agent, or Firm*—J. C. Evans

[57] ABSTRACT

A regenerator seal structure for a rotary regenerator of a gas turbine engine includes a rim bypass seal located on the hot surface of the matrix of the rotating regenerator including a semi-circular platform with a leaf spring on one surface thereof that is engageable with an engine block support platform to seal between the engine block and one surface of the platform with a free end thereof connected to an inboard edge of the platform and being secured thereto by a hinge member and wherein the platform includes a face seal element with its inboard edge located on the outer diameter of the platform at a point isolated from infrared radiation emissions from a combustor located within the engine housing; the platform including a substantial, radially extending semi-circular flat-plate heat exchanger segment thereon that is exposed to hot gas on one side and to cool gas on the opposite side and inboard of low heat conductivity attachment faces on the seal element to reduce conduction of heat from the inboard edge of the platform to the wear surface of the face seal element.

2 Claims, 3 Drawing Figures

SEAL HEAT SHIELD

This invention relates to seals for a rotary regenerator heat exchanger apparatus for gas turbine engines and more particularly to a rim bypass seal assembly for controlling gas bypass from the high pressure flow supplying combustion air to a combustor assembly of a gas turbine engine.

The use of rotating heat exchangers or regenerators to recover exhaust gas is a common approach to increasing efficiency in vehicular gas turbine engines and the like. Such heat recovery is desirable since much of the operating mode of such vehicular gas turbine engines is during light duty operation at which time only a fraction of the rated power of a gas turbine engine is produced. A rotary regenerator is typically preferred to a fixed stationary recuperator form of heat recovery system since rotary regenerators offer a reduced size advantage and furthermore have a reduced pressure drop for a given value of heat transfer effectiveness. However, in such arrangements it is necessary to include regenerator matrix rubbing seal assemblies to avoid excessive flow leakage from the engine during its operation.

The examples of such prior art seal assemblies are set forth in U.S. Pat. Nos. 3,743,008 issued July 7, 1973 to Zeek et al for "Regenerator Seal" and also in U.S. Pat. No. 3,856,077 issued Dec. 24, 1974 to Siegla for "Regenerator Seal".

In such arrangements the hot side, outer diameter rim bypass seal assembly is located so that the inboard edge of a wear seal member of a seal assembly is exposed to direct conduction of energy from the heated gas flow through the matrix of the regenerator disc and to infrared radiations from walls of a combustor assembly to cause oxidation of a seal wear face on the seal member.

Accordingly an object of the present invention is to reduce oxidation of the wear face of an inboard seal bypass rim of gas turbine engines exposed to high temperature combustor temperatures from within the gas turbine engine housing by provision of a wear seal element located on the outer radius of an extended width bypass rim platform having a leaf spring seal connected to the engine block housing side thereof by a separate hinge member at the inboard edge of the leaf seal and the inboard edge of the platform and with a wear seal element on the matrix side of the platform at a point radially outwardly on the platform to be isolated from infrared emissions from the combustor and wherein the bypass rim platform has a substantial radially extending segment thereof located inboard of the inboard edge of the wear face seal element to block direct infrared radiation from the combustor to the inner edge of the wear face seal element and to further define a flat plate heat exchanger segment that conducts heat from the platform prior to conduction thereof to the seal wear face and wherein low heat conductivity attachment faces further reduce heat conduction from the platform to the wear face seal element.

Another object of the present invention is to provide an arrangement as set forth above in a rotary regenerator on a gas turbine engine wherein the wear face seal element is biased by the spring seal against the hot surface of the rotating regenerator disc and the bypass seal is of a graphite composition that is in sliding engagement with a hot side surface of a matrix of the regenerator having approximately a coefficient of friction equal or less than 0.05 under 950° F. maximum steady state operating conditions.

These and other objects of the invention will be apparent from the following description, reference being had to the accompanying drawings wherein a preferred embodiment of the present invention is clearly shown.

Figure 1:
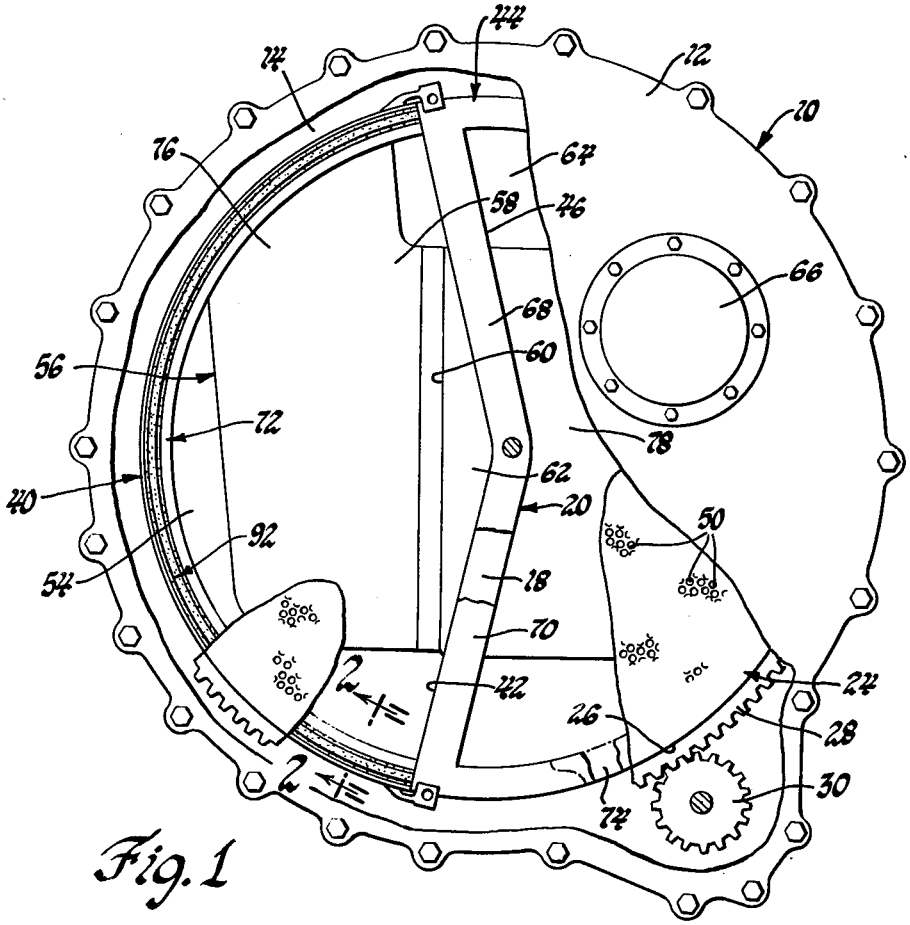
FIG. 1 is a side elevational view partially broken away of a rotatable regenerator assembly for use with the present invention.

Referring now to FIG. 1, a rotary regenerator assembly 10 includes a cover 12 on one side of an engine block 14. The block 14 includes an annular, undercut planar surface 16 therein to define a seal assembly support. Furthermore, the block 14 includes an integral cross arm 18 having a cross arm seal assembly 20 formed thereacross to engage the hot side surface 22 of a regenerator disc 24 in the form of a circular matrix having an outer rim 26 thereon secured to an annular drive ring 28 that is meshed with a drive pinion 30 from a cross drive assembly of the type set forth more particularly in copending U.S. application Ser. No. 831,616 filed Sept. 8, 1977 by Bell for "Water Cooled Gas Turbine Engine".

A cold surface seal assembly 32 engages the cold matrix surface 34 of the disc 24. It includes a platform 36, leaf spring seal 37 and wear face seal 38 connected thereto and engaged with cover 12 and surface 34 respectively. Examples of such an arrangement are more specifically set forth in U.S. Pat. No. 3,856,077. Furthermore, a hot side air bypass rim seal assembly 40 is located on surface 16 on one side 42 of the cross arm seal 20 and a gas side bypass rim seal assembly 44 is supported by the planar surface 16 on the opposite side 46 of the cross arm 18.

Thus, seal assemblies are provided between each of the hot and cold faces of the disc 24 and the housing defined by cover 12 and block 14. Such seal assemblies are included to confine cold and hot fluid flow through the regenerator to desired flow paths through the matrix from an inlet space or opening 48 which receives compressed air from a compressor of a gas turbine engine. The compressed air from the inlet opening 48 is directed through open ended pores or passages 50 in the disc 24. In one working embodiment, the matrix of disc 24 is fabricated from a ceramic material such as alumina silicate and has a cell wall thickness in the order of 0.008 cm, diagrammatically shown by the cell wall 52 of the fragmentary sectional view of FIG. 2.

The airflow from the opening 48 is heated as it flows through the rotating disc 24 and passes into a plenum 54 within the block 14 for a combustor can 56 where the compressed air from the opening 48 is heated by combustion with fuel flow into the combustor can 56.

The combustor can 56 has an outlet transition 58 thereon connected to an inlet end 60 of a turbine nozzle 62 which supplies motive fluid to a gasifier turbine and a downstream power turbine as more specifically set forth in the aforesaid U.S. application Ser. No. 831,616 of Bell.

Exhaust flow from the turbines enters through an exhaust passage 64 serving as a counterflow path to the hot surface 22 of the matrix disc 24 on the opposite side of the cross arm seal 20 from the plenum space 54 within the housing 14. The counterflow exhaust from passage 64 heats the matrix disc 24 as it passes through the pores 50 and thence is discharged through an exhaust opening 66 in the cover 12.

The cross arm seal assembly 20 and a like cross arm seal (not shown) on the matrix between it and the outer cover 12, includes two arms 68, 70 extending radially of the hot matrix surface and are preferably joined at the center of the matrix and joined at the outer rim of the matrix by the seal assemblies 40, 44. Assembly 40 has an arcuate platform 72 thereon and associated components that extend around the high pressure inlet opening 48 and plenum space 54. The gas side bypass rim seal assembly 44 likewise includes an arcuate platform 74 and associated parts that extend around the low pressure flow paths defined by the exhaust passage 64 and the exhaust opening 66. The seal assembly components thus define an opening 76 therebetween for high pressure air flow and an opening 78 therebetween for the low pressure exhaust gases from the gas turbine engines with these openings being best shown in FIG. 1 as conforming to the outline of the plenum space 54 and the exhaust passage 64 in the illustrated gas turbine block 14.

The seal arms 68, 70 extend between the high pressure and low pressure fluid paths and the seal assemblies 40, 44 seal the disc 24 adjacent to its outer periphery and to the block 14 for effectuating a pressure sealed relationship therebetween.

It has been observed that a desirable wear surface material against the hot side surface 22 of rotating disc 24 is graphite material which, run against a disc material, has a reduced coefficient of friction in the order of 0.05 at a maximum steady state operating condition of 950° F. While the present invention has application to any seal having a high temperature exposure on one side thereof and a reduced temperature exposure on the opposite side thereof, preferably it is intended for use on an air bypass seal such as that shown at 40 wherein the arcuate platform 72 has an inboard edge 80 thereon in facing relationship and in a direct line of sight relationship to infrared radiations from the wall of the combustor can 56. In such arrangements, the operating temperature of the outer surface of the can 56 can be in the order of 1400° F. to represent a high temperature source which can produce excessive oxidation of graphite seal wear surfaces that have an inboard edge that corresponds in location to edge 80 of the arcuate platform 72.

The arcuate platform 72 of the seal assembly 40 has a stainless steel leaf spring seal 82 upon one side thereof with a free edge 84 that extends through an arcuate extent corresponding to the arcuate extent of the platform 72 and is located against the planar surface 16 to be in sealing engagement therewith. The seal spring 82 further includes a fixed edge 86 thereon that is located at the inboard edge 80 by a hinge member 88 tack welded to the support platform 72. Thus, the assembly 40 includes an inboard layered extension 90 made up of member 88, edge 86 and edge 80 which together serve as a heat sink for direct infrared radiation energy from the combustor can 56. The assembly includes a wear face seal element 92 of an arcuate shape corresponding to the shape of platform 72. The seal element 92 is located on the outer diameter 94 of the platform 72 of assembly 40 where the element 92 is isolated from infrared radiation from the combustor can 56.

Figure 2:
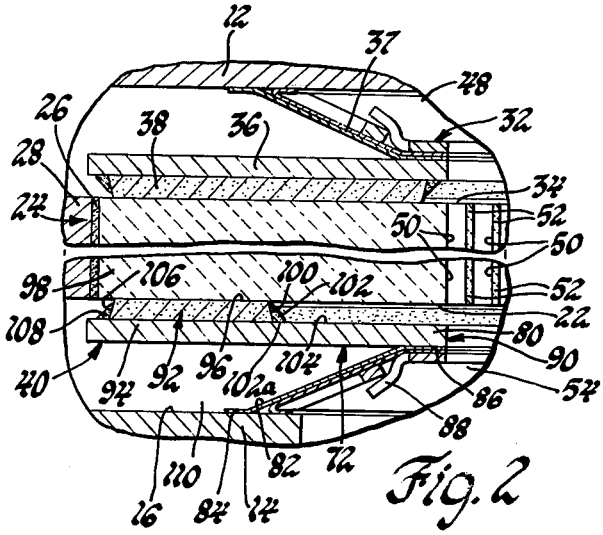
FIG. 2 is an enlarged, fragmentary sectional view taken along line 2—2 of FIG. 1 looking in the direction of the arrows.
Figure 3:
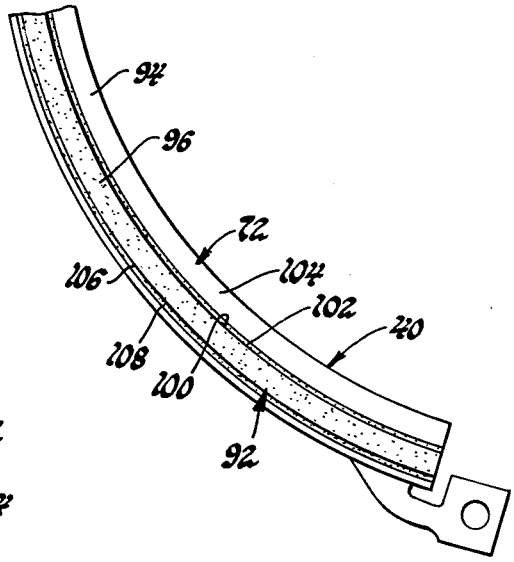
FIG. 3 is a fragmentary elevational view of a regenerator bypass rim seal of the present invention.

In the illustrated arrangement the wear face seal element 92 is made of graphite having a wear surface 96 thereon located in running engagement with the inboard surface of an impervious segment 98 of the disc 24. An inboard edge surface 100 of the graphite wear seal element 92 is covered by a plasma spray attachment 102 of nickel graphite which includes a limited attachment surface 102*a* against the platform 72 so as to retain an annular clean metal surface portion 104 on platform 72 defining a flat-plate heat exchanger segment thereon. Likewise the outboard arcuate edge surface 106 of the wear face seal element 92 is connected by a plasma spray attachment 108 to the outermost edge of the platform 72 as best shown in FIG. 2. Accordingly, there is a heat transfer across the platform portion 104 from the high temperature plenum space 54 to a lower temperature and pressure region represented by the space 110 in FIG. 2. This cools the platform 72 and reduces conduction of heat to the wear face seal element 92. In one working embodiment it has been found desirable to locate the wear surface completely on the outer half of the platform 72 as shown in FIG. 2 at a point where it will be effectively shielded from the elevated temperature conditions.

By virtue of the aforesaid arrangement, a wear face support platform and connector configuration is defined that reduces heat conduction from the combustor to the wear surface 96. Moreover, the wear surface 96 is located substantially on the outer half of the radial extent of the platform 72 at a cooler operating portion thereof which is further maintained cooler during regenerator operation by heat transfer across the platform 72 at the portion 104 thereon because of the fact that the platform 72 has the surface thereon free of any buildup of plasma attachment material thereon which, because of its increased heat conductivity would, if applied across the full surface of platform 72 tend to reduce heat transfer from the platform 72 and thus cause an undesirable conduction of heat from the hotter temperatures within the plenum 54 to the outboard extend of the platform 72 and to the wear face seal element 92.

As a result it has been observed that under high temperature operating conditions a graphite seal wear element 92 will retain an uninterrupted full planar extent wear and seal surface 96 to prevent excessive gas bypass from pressure space 110 to the plenum 54 so as to prevent excessive leakage of gas flow and reduced engine performance which would otherwise occur.

The embodiments of the invention in which an exclusive property or privilege is claimed are defined as follows:

1. In a rotary regenerator seal assembly with a hot side inlet and outlet sealed by a rim bypass seal and for use in a gas turbine with a rotary regenerator disc and combustor the improvement comprising:

an arcuate platform with an inboard edge, a leaf spring seal having one end thereon fixed to said inboard edge of the platform, means including said platform and said leaf spring seal defining therebetween a low temperature air plenum separated by said leaf spring from high temperature gas at the regenerator hot side outlet, a wear face seal element supported on the outer diameter of said platform and including a wear surface thereon held by said leaf spring seal in spring biased sealing relation with the hot side of the disc, said arcuate platform including an extension offset inboard of said seal element to define a flat plate heat exchange segment for cooling said platform thereby to reduce conductive heat transfer through the platform from the inboard end thereof to the wear face seal element, said platform extension having an axial extent that shields the wear face seal element from infrared radiation produced at the combustor thereby to prevent excessive temperature build-up in the wear face seal element during gas turbine engine operations.

2. In a rotary regenerator seal assembly with a hot side inlet and outlet sealed by a rim bypass seal and for use in a gas turbine with a rotary regenerator disc and combustor the improvement comprising:

an arcuate platform with an inboard edge, a leaf spring seal having one end thereon fixed to said inboard edge of the platform, means including said platform and said leaf spring seal defining therebetween a low temperature air plenum separated by said leaf spring from high temperature gas at the regenerator hot side outlet, a wear face seal element supported on the outer diameter of said platform and including a wear surface thereon held by said leaf spring seal in spring biased sealing relation with the hot side of the disc, said arcuate platform including an extension offset inboard of said seal element to define a flat plate heat exchange segment for cooling said platform thereby to reduce conductive heat transfer through the platform from the inboard end thereof to the wear face seal element, said platform extension having an axial extent that shields the wear face seal element from infrared radiation produced at the combustor thereby to prevent excessive temperature buildup in the wear face seal element during gas turbine engine operations, said wear face seal element being located on the outer one-half of the diameter of said arcuate platform and having side edges connected thereto and to said platform through a limited extent to maintain a clean surface on said extension for transfer of heat from said platform.

* * * * *